US005288955A

United States Patent [19]

Staple et al.

[11] Patent Number: 5,288,955

[45] Date of Patent: Feb. 22, 1994

[54] WIND NOISE AND VIBRATION NOISE REDUCING MICROPHONE

[75] Inventors: Bruce W. Staple, Coral Springs; Greg A. Schladt, Sunrise, both of Fla.; Martin E. Holmes, Hoffman Estates, Ill.

[73] Assignee: Motorola, Inc., Schaumburg, Ill.

[21] Appl. No.: 97,307

[22] Filed: Jul. 26, 1993

Related U.S. Application Data

[63] Continuation of Ser. No. 894,704, Jun. 5, 1992, abandoned.

[51] Int. Cl.[5] ..... G10K 13/00

[52] U.S. Cl. ..... 181/158; 181/171

[58] Field of Search ..... 181/242, 158, 171, 199, 181/207, 208, 211; 381/94, 91, 169

[56] References Cited

U.S. PATENT DOCUMENTS

| | | | |
|---|---|---|---|
| 2,065,456 | 12/1936 | Hayenga et al. | 181/242 |
| 2,520,706 | 8/1950 | Anderson et al. | 181/242 |
| 3,153,123 | 10/1964 | Harman | 381/169 |
| 3,573,401 | 4/1971 | Lininger | 381/169 |
| 4,151,777 | 5/1979 | Sugiyama | 181/158 X |
| 4,463,222 | 7/1984 | Poradowski | 381/94 X |
| 4,493,471 | 1/1985 | McInnis | 181/208 X |
| 4,789,044 | 12/1988 | Akino | 181/158 |
| 4,850,016 | 7/1989 | Groves et al. | 381/155 X |

*Primary Examiner*—Michael L. Gellner
*Assistant Examiner*—Khanh Dang
*Attorney, Agent, or Firm*—Dale W. Dorinski

[57] ABSTRACT

A wind noise and vibration noise reducing microphone arrangement is formed in a bullet-shaped housing (12) having a rounded front portion (13) and a flat rear portion (15). The rear portion is substantially perpendicular to the side portions (14) and contains a transducer (10) facing in the opposite direction from the forward portion. The transducer is mounted to the housing with an elastomeric member (25) that also serves as a seal between the transducer and the housing. The elastomeric member also reduces vibrations transmitted to the microphone. A mounting means (30) is attached to the housing. The mounting means has a vibration isolation member (32) to reduce vibrations transmitted to the housing. The mounting means can be an aerodynamic pedestal attached to the housing, with an elastomeric member attached to the pedestal to reduce vibrations. The pedestal is attached to a vehicle such as a bicycle (6), motorcycle, glider, or boat, and the elastomeric member reduces the vibration transmitted from the vehicle to the housing. The microphone arrangement is connected to a radio transmitter (4) mounted on the bicycle, and transmits the rider's voice to another remote radio receiver.

21 Claims, 2 Drawing Sheets

WIND NOISE AND VIBRATION NOISE REDUCING MICROPHONE

This is a continuation of application Ser. No. 07/894,704, filed Jun. 5, 1992, and now abandoned.

TECHNICAL FIELD

This invention relates to noise reducing microphones, and more particularly to a microphone mounting arrangement within a housing for reducing noise arising from wind and vibration.

BACKGROUND OF THE INVENTION

Outdoor uses of radio communications are many, such as hiking, camping, hunting, biking, warehousing, construction, security, etc. One example of a communication device for these applications is a portable two-way FM transceiver that utilizes an earphone-microphone to transmit via vibrations in the auditory canal. This system provides rudimentary communications, but suffers from poor intelligibility of the spoken word. In these applications, communications involves the use of a microphone that is exposed to winds. Microphones used outdoors are subject to background noise. One method typically used to reduce environmental noise in microphone assemblies is the well-known noise canceling microphone. They are sometimes also referred to as pressure gradient microphones. These microphones consist of a vibratable diaphragm which is actuated by speech or other sounds. The diaphragm is arranged so that sound paths are provided through ports to both the front and rear sides thereof. Far field signals, consisting of environmental noise, reach both sides of the diaphragm simultaneously and are canceled. Near field signals, such as the user's voice, predominately reach only one side of the diaphragm, and are not canceled. Prior art microphones of this type are unsuitable for use in high wind environments because they are ineffective due to the directional nature of wind. Optimal sound characteristics and reproduction of natural sound for a communication device also requires a flat frequency response to a near field sound source. In a noise canceling microphone, the frequency response varies with the acoustic loading on the two ports.

Wind noise is caused by the wind vibrating the diaphragm of the microphone, creating a signal which can be equal to or greater than the user's voice signal, thereby obliterating the voice message. One method of reducing wind noise is to cover the microphone with a layer of foam. The foam ball wind suppresser, typically used by television reporters, is a well-known example of this type of wind noise reducing mechanism. Unfortunately, these types of suppressers are only effective in light winds. In strong winds, such as those experienced by a rider on a bicycle or motorcycle, for example, the foam suppresser does not adequately remove the background wind noise, and the voice signal is unintelligible.

A third source of noise in microphones used outdoors is vibrational noise. This noise arises from mechanical vibrations transmitted to the microphone diaphragm through the mounting structure and the housing. Sources of mechanical vibrations in vehicle mounted microphones are road vibration, engine vibrations, noise from a moving bicycle chain, and other mechanical noise induced by the vehicle.

None of the conventional microphone designs are suitable for use in an environment that has high winds and vibrations. Furthermore, noise canceling microphones are not noted for their environmental sealing ability, and are thus unsuitable for use in inclement weather.

SUMMARY OF THE INVENTION

A wind noise and vibration noise reducing microphone arrangement comprises a bullet-shaped housing having a rounded front portion and a flat rear portion. The rear portion is substantially perpendicular to the side portions, and contains a transducer facing in the opposite direction from the forward portion. The transducer is mounted to the housing with an elastomeric member that also serves as a seal between the transducer and the housing. The elastomeric member also reduces vibrations transmitted to the microphone.

In a further aspect of the invention, a mounting means is attached to the housing. The mounting means has a vibration isolation means to reduce vibrations transmitted to the housing.

In still another aspect of the invention, an aerodynamic pedestal is attached to the housing, and an elastomeric member is attached to the pedestal. The pedestal is attached to a vehicle such as a bicycle or motorcycle, and the elastomeric member reduces the vibration transmitted from the vehicle to the housing.

DESCRIPTION OF THE PREFERRED EMBODIMENT

Figure 1:
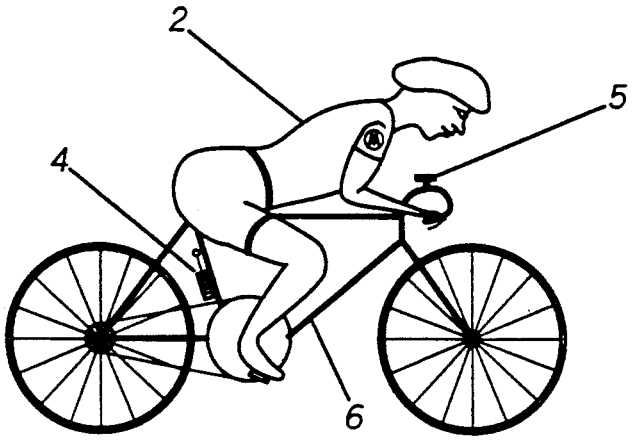
FIG. 1 is a view of a microphone and radio transmitter mounted to a bicycle in accordance with the invention.

Bicycle racers need to communicate with their support crew during a race, and this is most effectively accomplished with a two-way radio. Referring to FIG. 1, a view of a microphone assembly 5 mounted to a bicycle 6 in accordance with the present invention is shown. The small size and aerodynamic shape of the microphone assembly 5 is important in reducing windage on a racing bicycle. By placing the microphone assembly 5 on the bicycle handlebars, the rider 2 can easily speak into the microphone. The microphone assembly 5 is connected to a radio transmitter 4 mounted on the bicycle, and transmits the rider's voice to another remote radio receiver.

Figure 2:
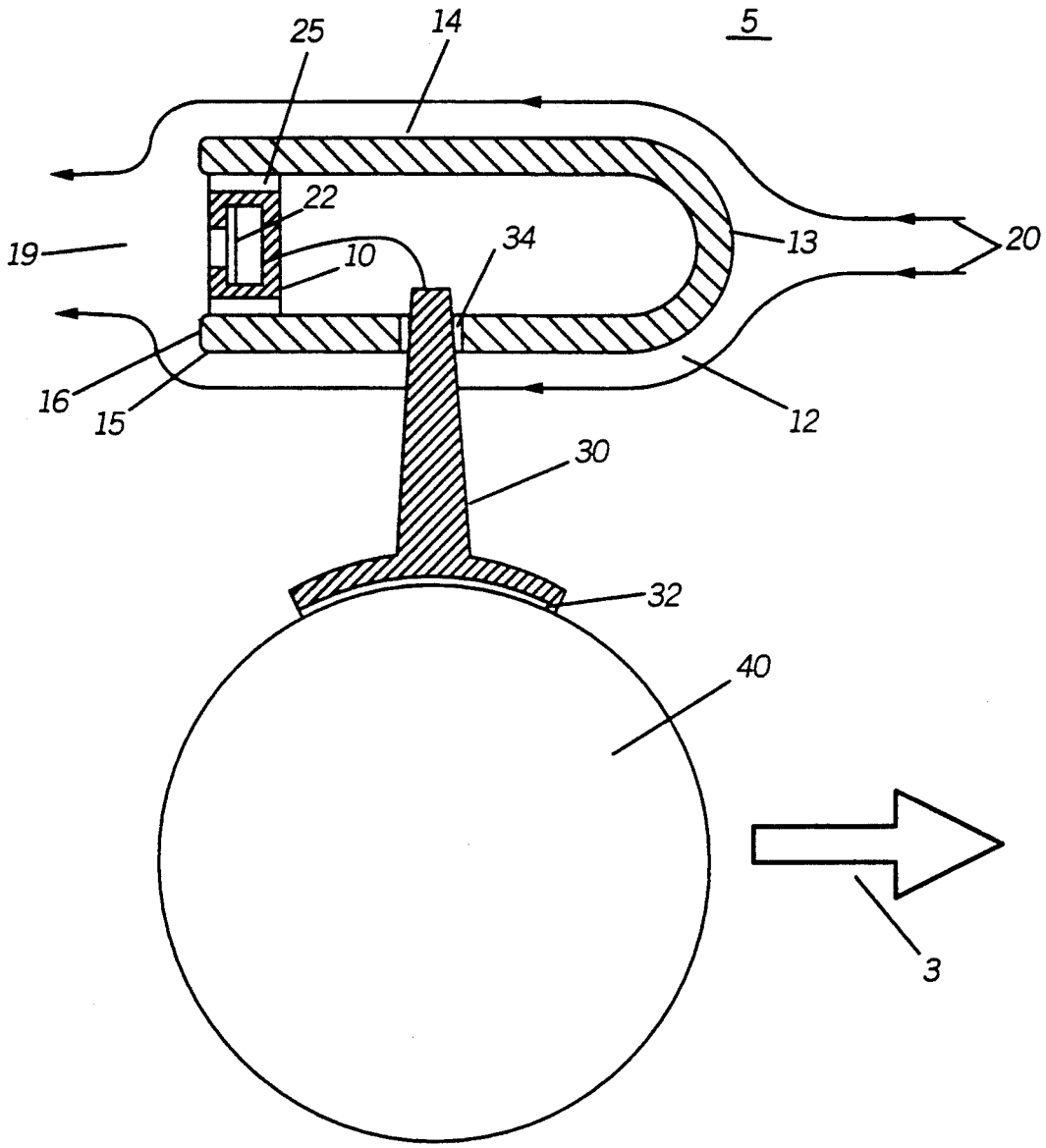
FIG. 2 is a cross-sectional view of a microphone assembly in accordance with the present invention.

Referring to FIG. 2, there is generally shown a cross-sectional view of a wind noise and vibration noise reducing microphone 5 in accordance with the present invention. A microphone cartridge or transducer 10 is mounted in an aerodynamic housing 12. The housing 12 is appropriately shaped so as to have three distinct portions: a rounded front portion 13, a central portion 14 and a rear portion 15. The front portion 13 is generally rounded in shape, and the preferred embodiment can best be described as being convex shaped, that is, having a curved form which bulges outwardly, resembling the exterior of a sphere. Other forms similar to this shape may be employed with varying efficacy, such as globular, bulb-shapes, ovoid, or egg shaped. The intent of the rounded front portion is to create an aerodynamic shape that deflects the oncoming wind while creating minimal turbulence. It is well known that these types of rounded shapes are more efficient to this end than concave, linear or curvilinear shapes.

The central portion 14 of the housing 12 is preferably uniform in cross section. That is, the maximum diameter of the center portion 14 should be no greater than the maximum diameter of the front portion 13 or the rear portion 15. When viewed in a section perpendicular to the plane of the FIG. 1, the preferred shape is generally circular. Other shapes may, of course, be employed, such as elliptical or ovoid, along with square or rectangular, but such shapes should have rounded edges or corners. All exterior surfaces and edges of the housing 12 are preferably smooth and rounded, to reduce wind turbulence.

The rear portion 15 of the housing is generally squared off, and is predominately perpendicular to the central portion 14. That is, the face 16 of the rear portion 15 is perpendicular to the sides of the central portion 14, and is generally flat. The microphone cartridge or transducer 10 resides in the rear portion 15 of the substantially tubular housing chamber, preferably at the very end of the chamber to optimize the performance of the transducer 10. As shown, the microphone 10 lies in the rear portion of the housing, flush with the end of the housing.

By creating a bullet-shaped housing 12 with the microphone cartridge 10 mounted on the rear or flat portion 15 of the housing, wind 20 coming from the front of the housing 12 is gently deflected around the bullet shape (as indicated by the arrows). The wind flow continues along the sides of the central portion 14, and upon reaching the rear edge 15 of the housing, tends to continue on for a certain distance in a relatively straight path. This creates a partial vacuum 19 at the rear face 16 of the housing 12. There is little or no turbulence or wind in this area (19), similar to that experienced when one stands on the downwind side of a building on a windy day. By placing the microphone cartridge 10 at the rear face 16 of the housing, the wind 20 does not hit the microphone face since it is inside the evacuated portion 19 of the air stream, thereby eliminating the impingement of the wind of the diaphragm 22. This eliminates the noise normally produced by the wind 20 vibrating the diaphragm 22 since the microphone 10 is in a shaded or protected portion 19 of the airstream 20.

In the preferred embodiment, the microphone cartridge 10 is mounted at the rear edge of the housing 12, and is not recessed in the housing cavity. It is flush with the edge of the housing 12. If the microphone cartridge 10 were to be recessed into the housing 12 or protrude beyond the rear edge 15 of the housing, it would create eddy currents at the rear edge, causing the diaphragm 22 to vibrate, thereby reducing the effectiveness of the wind noise reduction scheme.

Figure 3:
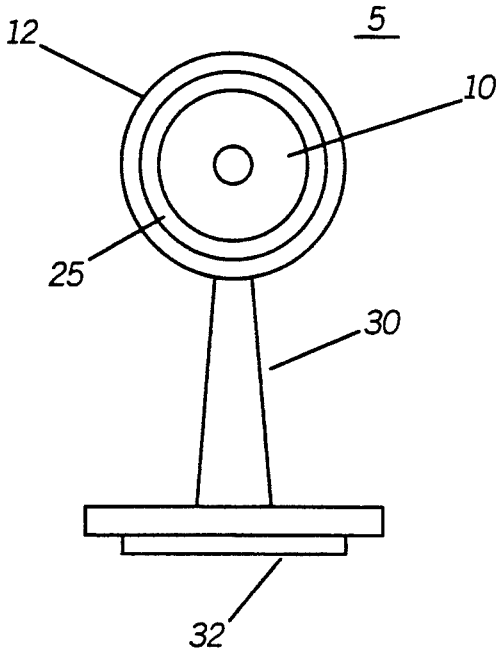
FIG. 3 is an end view of a microphone assembly in accordance with the present invention.

Referring now to FIG. 3, there is shown an end view of the microphone assembly, including the microphone cartridge 10 and a seal or boot 25, preferably made of a rubber or foam material such as natural rubber, silicone rubber, urethane rubber, or other elastomers. The boot 25 comprises a substantially circular member which retains the cartridge 10 in place and seals to the housing 12. The purpose of the boot 25 is two-fold. First, it provides an environmental seal between the cartridge 10 and the housing 25 to prevent dirt and moisture from intruding into the housing. Second, the elastomeric nature of the boot 25 provides shock or vibration isolation between the cartridge 10 and the housing 12. The boot 25 may assume numerous forms and can even be a formed-in-place elastomer, such as a silicone rubber sealant. The exact configuration of the boot 25 is not critical but should serve to properly mount and retain the cartridge 10 in the housing 12.

As noted previously, microphone noise also arises from mechanical vibrations transmitted to the microphone diaphragm through the mounting structure and the housing. Sources of mechanical vibrations in vehicle mounted microphones are road vibrations, engine vibrations, noise from a moving bicycle chain, and other mechanical noise induced by the vehicle. By mounting the cartridge 10 in an elastomeric member 25, vibrations are effectively damped and isolated from the cartridge, thereby reducing or eliminating the mechanical noise.

In order to mount the microphone assembly on a vehicle or other transportation means, such as a boat, an airplane, a glider, or a motorcycle, a mounting means 30 is attached to the housing 12. In the preferred embodiment, the mounting means 30 is an aerodynamically shaped pedestal as shown in FIGS. 2 and 3. The mounting means 30 may also contain a vibration isolation means such as a rubber or foam pad 32 at the base of the means 30. This serves to isolate the mounting means 30 from vibrations transmitted through the vehicle or workpiece. In one embodiment, the microphone assembly 5 is mounted to the handlebars 40 of a bicycle, with the rubber pad 32 between the pedestal 30 and the handlebars. A second vibration isolation means 34 may be used in place of, or conjunction with, the rubber pad 32. This isolation means 34 is placed between the housing 12 and the mounting means 30. The user may also envision that the entire mounting means 30 could be made from a vibration isolating material such as rubber or foam, thereby eliminating the separate isolation means 32 and 34. Of course, other means of mounting the microphone 5 can be envisioned and still fall within the spirit and scope of the invention.

When the microphone assembly 5 is mounted, for example, on a bicycle traveling in a direction shown by the large arrow 3, the major component of the wind velocity arises from the front, as shown by the arrows 20. Transient winds from the side or the back of the housing 12 do not affect the aerodynamic performance of the microphone 5, since they are much smaller than the main component of the wind 20. The microphone cartridge or transducer 10 is preferably an omnidirectional microphone cartridge, to allow the normal spoken voice to be easily picked up from the rear and sides of the housing. When the user is talking to the back of the housing 12, the partial vacuum 19 does not interfere with the normal spoken voice.

Wind tunnel testing and tests in outdoor environments have shown that a normal spoken voice is reproduced quite faithfully, with little background noise. Measurements of background noise levels in a controlled environment such as a wind tunnel have shown that the instant invention provides a significant reduction in noise level compared to a conventional microphone. The decibel (dB) reduction in background noise results in an improvement in the quality of the communications. Other testing showed that wind noise produced by a cyclist traveling at 50 kilometers per hour was significantly reduced when the microphone as described in the instant invention was substituted for a conventional microphone. The present invention overcoes many problems associated with the prior art, while providing the acoustic and environmental sealing properties needed for a high quality, noise reducing microphone.

We claim as our invention:

1. A wind noise and vibration noise reducing microphone arrangement for use in a wind stream, comprising:

a bullet shaped housing having side portions, a rounded front portion, and a flat rear portion, said rear flat portion being substantially planar and substantially perpendicular to said side portions;

a transducer mounted in the flat rear portion of said housing, facing in a direction opposite to said rounded front portion, so as to reside in an area protected from the wind stream, and mounted in said housing by an elastomeric sealing means.

2. The microphone arrangement of claim 1, wherein said transducer comprises an omnidirectional microphone.

3. The microphone arrangement of claim 1, wherein the cross sectional shape of said housing is substantially circular.

4. The microphone arrangement of claim 1, further comprising a mounting means attached to said housing, for mounting said microphone arrangement to a vehicle.

5. The microphone arrangement of claim 4, wherein said mounting means further comprises a vibration isolating means.

6. A microphone assembly for reducing noise generated by a wind stream and noise generated by vibration, comprising:

a housing having a front portion, side portions, and a flat rear portion said front portion being generally rounded and convex in shape, and said flat rear portion being substantially planar and substantially perpendicular to said side portions;

a microphone mounted in said housing flat rear portion, so as to reside in an area that is protected from said wind stream;

means for mounting said microphone assembly to a workpiece;

a first vibration isolating means attached to said means for mounting;

a second vibration isolating means retaining said microphone within the flat rear portion of said housing, thereby sealing said housing.

7. The microphone assembly of claim 6, wherein said mounting means comprises a pedestal.

8. The microphone assembly of claim 6, wherein said first vibration isolating means comprises an elastomeric member.

9. The microphone assembly of claim 6, wherein said second vibration isolating means comprises an elastomeric boot a first portion of said elastomeric boot attached to said housing, and a second portion of said elastomeric boot attached to said microphone.

10. The microphone assembly of claim 9, wherein said second vibration isolating means also provides an acoustic seal between the microphone and the housing.

11. The microphone assembly of claim 9, wherein said second vibration isolating means also provides an environmental seal between the microphone and the housing.

12. The microphone assembly of claim 6, wherein said housing side portions are substantially uniform in cross section.

13. The microphone assembly of claim 6, wherein said housing side portions are substantially similar in size and shape to said housing front and rear portions.

14. The microphone assembly of claim 6, wherein the cross sectional shape of said housing is substantially circular.

15. The microphone assembly of claim 6, wherein said microphone comprises an omnidirectional microphone.

16. The microphone assembly of claim 6, wherein the first vibration means and the mounting means are a single means.

17. A microphone assembly for use with a radio transmitter, that reduces windstream noise and vibration noise, comprising:

a housing having a forward portion, a central portion, and a rear portion, said forward portion being generally convex shaped to provide an aerodynamic shape, said central portion being substantially uniform in cross section, and said rear portion being generally flat and substantially perpendicular to a longitudinal axis of said housing;

means for mounting said microphone assembly to a vehicle, said housing forward portion facing a front of said vehicle and facing into said windstream;

vibration isolating means attached to said means for mounting;

an omnidirectional microphone mounted in said rear portion of said housing, said microphone facing in a direction opposite to said windstream and protected from said windstream, thereby reducing the noise produced by the windstream; and means for retaining said microphone within said rear portion of said housing, and retaining means isolating said microphone from vibration and sealing and housing.

18. The microphone assembly of claim 17, wherein the vehicle comprises a bicycle and the microphone assembly is mounted to the handlebars.

19. The microphone assembly of claim 17, wherein the microphone assembly is electrically connected to the radio transmitter.

20. The microphone assembly of claim 17, wherein said retaining means comprises an elastomeric member.

21. A communication system for a moving vehicle, comprising:

a radio transmitter mounted to said vehicle;

a remote microphone assembly electrically connected to said radio transmitter and mounted to said vehicle, facing a front of said vehicle and facing into a windstream generated by said vehicle, comprising:

a housing having a forward portion, a central portion, and a rear portion, said forward portion being generally convex shaped to provide an aerodynamic shape, said central portion being substantially uniform in cross section, and said rear portion being generally flat and substantially perpendicular to a longitudinal axis of said housing;

an omnidirectional microphone mounted in said rear portion of said housing, said microphone facing in a direction opposite to said windstream and protected from said windstream; and means for retaining said microphone within said rear portion of said housing, said retaining means isolating said microphone from vibration and sealing said housing.

* * * * *